10/22/85 4,548,269

United States Patent [19]

Elson et al.

[11] Patent Number: 4,548,269

[45] Date of Patent: Oct. 22, 1985

[54] STEAM INJECTION WELL GRAVEL PREPACK MATERIAL OF SINTERED BAUXITE

[75] Inventors: Thomas D. Elson, Chino; Ralph S. Millhone, Brea, both of Calif.

[73] Assignee: Chevron Research Company, San Francisco, Calif.

[21] Appl. No.: 628,011

[22] Filed: Jul. 5, 1984

Related U.S. Application Data

[62] Division of Ser. No. 455,372, Jan. 3, 1983, abandoned.

[51] Int. Cl.[4] ..... E21B 43/04

[52] U.S. Cl. ..... 166/276; 166/278; 166/371

[58] Field of Search ..... 166/228, 227, 280, 51, 166/278, 276, 371

[56] References Cited

U.S. PATENT DOCUMENTS

| | | | |
|---|---|---|---|
| 2,600,150 | 6/1952 | Abendroth | 166/228 |
| 3,534,816 | 10/1970 | Showwalter | 166/228 |
| 3,768,557 | 10/1973 | Spurlock et al. | 166/228 |
| 4,068,718 | 1/1978 | Cooke, Jr. et al. | 166/280 |
| 4,120,359 | 3/1977 | Harnsberger | 166/278 |
| 4,247,430 | 1/1981 | Constien | 166/276 |

FOREIGN PATENT DOCUMENTS

| | | | |
|---|---|---|---|
| 2037727 | 7/1980 | United Kingdom | 166/280 |

*Primary Examiner*—Stephen J. Novosad
*Assistant Examiner*—William P. Neuder
*Attorney, Agent, or Firm*—Lewis S. Gruber; Edward J. Keeling

[57] ABSTRACT

A packing material useful in a gravel pack for open or cased wells or in a prepack for use in steam or hot fluid injection and production wells. The packing material is a material which is insoluble in high temperature caustic fluids and subsurface formation fluids. Sintered bauxite is a claimed material.

1 Claim, 4 Drawing Figures

STEAM INJECTION WELL GRAVEL PREPACK MATERIAL OF SINTERED BAUXITE

This is a division of application Ser. No. 455,372, filed Jan. 3, 1983, now abandoned.

BACKGROUND OF THE INVENTION

This invention relates to the construction of gravel pack or prepack elements in steam injection wells. In particular it relates to the use of granular sintered bauxite material as the packing material for a gravel pack or prepack placed in a steam injection well.

Gravel packs are used in the oil well industry as downhole filters designed to prevent formation sand from entering the wellbore and causing subsequent damage. A gravel pack is placed by pumping a gravel slurry downhole around a liner. Once in place, the gravel prevents formation sand migration while the liner retains the gravel. A prepack is a surface-made gravel pack where gravel is retained within two concentric screens. Both a gravel pack and a prepack can be used in open or cased holes. They have been used successfully for many years as sand control techniques with the gravel pack being the most common and effective method. Typical application of either a gravel pack or prepack is in wells producing fluids from loosely consolidated sandstone. These sands may have little or no cementing material and as a result of fluid flow into a wellbore, the formation material may readily be produced and cause severe wellbore or surface damage due to erosion or plugging.

The usual filter medium in a gravel pack or prepack is silica gravel presized so that its pore structure will prevent passage of formation sand. It is surface mined from unconsolidated sand deposits and then processed by screening to produce a narrow range of particle sizes. The prior art has established primary and secondary size ranges and acceptable range tolerances recommended for gravel packing, particularly when used in petroleum producing wells.

The life of a gravel pack or prepack installed in a wellbore may not be permanent. Some failures are attributed to improper placement of gravel packs or screen erosion in prepacks. Two common threats to a gravel pack or a prepack are plugging and degradation or chemical decomposition of the gravel material within the pack. For many operating conditions such destruction is not a threat because the fluids produced or injected through the pack are not corrosive to the silica gravel. However, a significant application of gravel packing (and to a lesser extent, use of prepacks) is in wells undergoing steam injection. It has been demonstrated that the conditions that exist in steam injection wells are highly conducive to silica gravel dissolution and subsequent sand control failure when the well is later used as a producing well. (See Reed, M. G.; "Gravel Pack and Formation Sandstone Dissolution during Steam Injection," J. Pet. Tech. (June 1980) p. 941; and McCorriston, L. L. et al.; "Study of Reservoir Damage Produced in Heavy Oil Formations Due to Steam Injection," SPE Preprint 10077, SPE Fall Mtg., San Antonio, TX, Oct. 5–7, 1981.)

The lifetime of a gravel pack or prepack in thermal wells could be extended to improved economic levels if the silica gravel could be replaced with a more steam resistant material. A major disadvantage of using silica gravel in thermal wells is its solubility. A replacement for silica gravel would preferably have all the characteristics which are beneficial to sand control while being less soluble in the steam that is to be injected through the pack.

OBJECTS OF THE INVENTION

In accord with the previous statements concerning the prior art, it is an object of the present invention to produce a gravel packing material or a material for placement in a prepack which will be substantially insoluble at stimulating steam injection conditions. Further objects and features of the present invention will be readily apparent to those skilled in the art from the appended drawings and specification illustrating a preferred embodiment wherein.

DESCRIPTION OF PREFERRED EMBODIMENT

Figure 1:
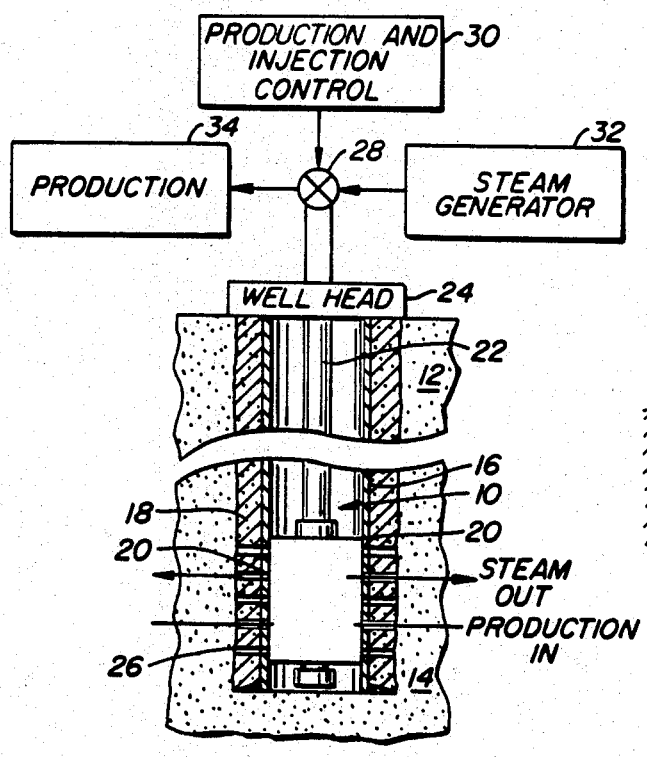
FIG. 1 is a sectional view through an earth formation illustrating the surface and subsurface environment of the present invention.

The present invention is useful in the environment illustrated in FIG. 1 where a well 10 is illustrated as penetrating an earth formation 12 to a subsurface petroleum-containing zone 14. The well may include casing 16 cemented at 18 along the formation and perforated at 20 within the petroleum-containing zone. A tubing string 22 is positioned within the casing 16 and is connected at the earth's surface to a wellhead 24 and operationally to a gravel pack 26 at the end adjacent the petroleum-containing zone.

At the earth's surface above the wellhead 24 the tubing 22 is provided with a valve 28 and a controller 30 for controlling the injection of steam or hot fluids from steam generator 32 or the production of well fluids to production handling equipment at 34.

FIG. 1 is intended to illustrate the possible oil field environment wherein steam and/or hot fluids are injected into a subsurface formation containing immobile petroleum (e.g., highly viscous heavy crude) for the purpose of heating and mobilizing the petroleum. This same surface and subsurface equipment is then used for the production of fluids from the formation. The fluids so produced include some of the injected fluids and some of the now heated and mobilized formation petroleum.

It is not unusual for formations containing highly viscous immobile petroleum to be loosely consolidated sandstone. These sands move with the produced formation fluids and flow into the wellbore. In the worst of conditions, the sands plug the perforations 20 through the casing 16 and prevent the further production of formation fluids. Even if the perforations are not plugged, the production of formation sands sometimes causes severe damage to the formations and the wellbore during production and also causes damage to surface equipment because of their abrasive character. It is therefore desirable to prevent movement of the formation sands with the produced fluids.

It has long been known and a usual practice in producing petroleum under natural or conventional methods to place a gravel pack in the annulus between the inner production tubing and the perforated casing in the form of a prepack or a pack placed into the well. Gravel packs may also be placed in uncased or open wells filling the entire open hole below the casing. In such gravel packs the gravel is usually graded sands selected in size distribution to prevent movement of the formation sand grains.

When the petroleum-containing formation is unconsolidated sandstones and if, for example, the petroleum within the formation is very heavy crude that will only flow to a producing well when mobilized by being heated, it has been the usual practice to inject steam or other hot fluids into the formation to mobilize the crude. If such mobilized crude tends to carry with it the formation sands then the gravel packed annulus is needed. Such a gravel pack must be placed before the well is stimulated by the injected steam or hot fluid because it would be impractical to place the gravel pack into a hot subsurface formation.

It has been found that conventional gravel packs dissolve in the injected fluids because of the high temperature and the corrosive character of the injected fluids. Many materials which would be thought to be totally insoluble in injection fluids have been found to substantially totally disappear during the extended periods of fluid injection in the oil field stimulation techniques. Some steam stimulation programs prescribe the injection of steam continuously for several years before fluids are produced from the formations.

The present inventor has discovered that a material is available that can be useful in overcoming the failure of conventional gravel packing materials. For the purposes of packing the annulus of a steam injection well it is desirable that the packing material should have the following characteristics:

| | |
|---|---|
| Particle size range | between 2 and >100 US mesh |
| Roundness | >0.6* |
| Sphericity | >0.6* |
| Specific gravity | >0.1 |
| Compressive strength | >2000 psi |
| Acid solubility | <1.0% by weight using API test** |
| Steam solubility | insoluble |

*Krumbein Scale published in Stratigraphy and Sedimentation, 2nd Ed., 1955, W. H. Freeman & Co., S.F., Californnia.

**Recommended Practices for Testing Sand Used in Gravel Packing Operations, (Tentative).

A material satisfying these criteria is sintered bauxite. Its solubility under simulated steam injection conditions has been found to be 50–100 times less than the highest quality silica sands currently being used in the petroleum industry.

Figure 2:
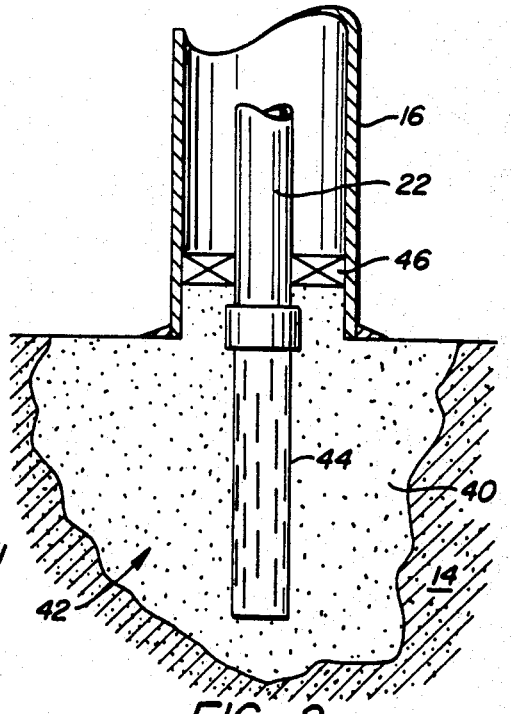
FIG. 2 is a sectional view through a subsurface completion of a well illustrating a gravel pack in an open hole well.
Figure 3:
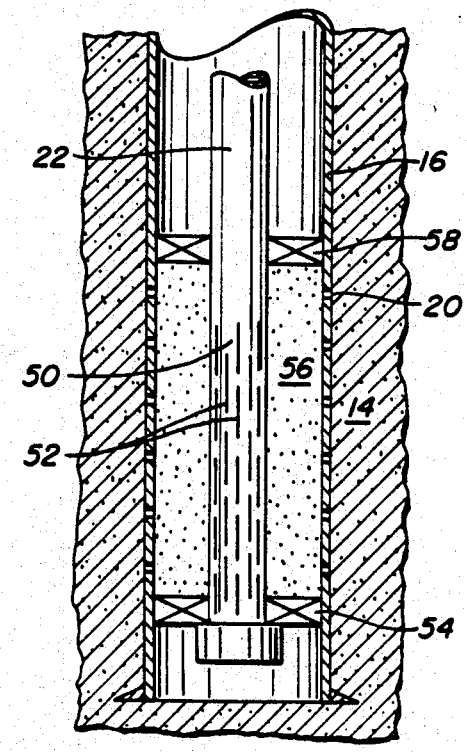
FIG. 3 is a sectional view through a subsurface completion of a well illustrating a gravel pack placed in the annulus between a casing and a liner.
Figure 4:
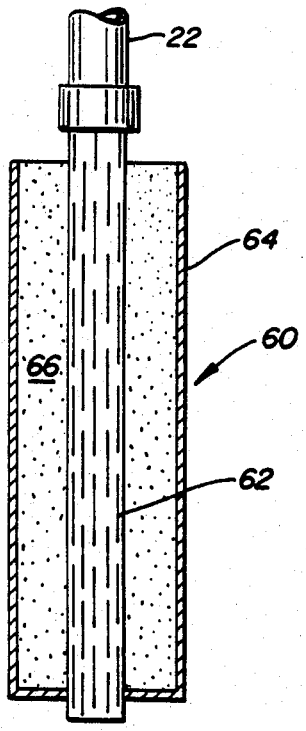
FIG. 4 is a sectional view through a prepack showing a gravel pack in the annulus between an inner liner and an outer liner.

FIGS. 2, 3, and 4 show typical installation of sintered bauxite packing materials in a gravel pack of a subsurface petroleum-containing formation. In FIG. 2 an installation is illustrated in an open hole below a cased well. The sintered bauxite 40 is placed in a conventional manner as by being pumped into the subsurface location 42 after the tubing 22 has been placed within the casing 16. The downhole end of the tubing includes a slotted, wire-wrapped or perforated liner 44 that permits the carrier fluid to flow back to the wellhead up the tubing while the sintered bauxite 40 remains in the packed zone. A packer 46 is placed above the packed zone to isolate the annulus above the packer from the injection/production zone 42.

FIG. 3 illustrates a gravel pack placed in a cased well. The casing 16 is perforated at 20 to provide an opening to the petroleum-containing formation 14. At the downhole end of an inner tubing 22 an inner liner 50 having slots or perforations at 52 is placed within the casing 16 and a lower packer 54 is positioned at the downhole end of the zone to be packed. The packing material 56 is pumped down the tubing and through a packing tool (not shown) to be placed in the annulus between the inner liner and casing. When the packing has been placed the packing tool is removed and a packer 58 may be placed at the top end of the pack.

FIG. 4 illustrates a prepack element 60 which may be placed within a well either an open hole as in FIG. 2 or in a cased well as in FIG. 3. The prepack consists of an inner screen 62 which may be slotted, perforated or wire wrapped and an outer screen 64 which also may be slotted, perforated or wire wrapped. Within the prepack the annulus is filled with packing material at 66. The screens and the packing material establish a porous, permeable element which will permit fluids to flow into the hollow interior of the screen 62 and through the tubing 22 to which it is attached. The prepack is placed within the well adjacent to the petroleum-containing formation as in FIG. 2 or 3.

The prepack 60 provides an assurance that the pack material has been adequately placed; however, it is a well element that must be run into the well and placed in the desired position adjacent to the petroleum-containing zone or in the position where materials are to be injected into the formation.

A packing material adapted to use in this application is sintered bauxite. That material may be produced in desirable sizes to provide the range of sized material recommended for use in well gravel packing. Sintered bauxite can withstand the caustic environment of a steam injection well as well as the fluid environment found when formation fluids are produced through the packing.

The preferred range of particulate sizes is between 2 and 100 mesh. Sintered bauxite is available in that range of sizes. The pack material should have a roundness and sphericity greater than 0.6, a specific gravity greater than 0.1 and a compressive strength greater than 2000 psi.

SINTERED BAUXITE

Sintered bauxite is commercially available from The Norton Company, the Carborundum Company and others. It is manufactured by grinding calcined bauxite ore to a desired powder size, compacting the powder at high pressure into agglomerated rounded masses of generally desired sizes, and finally subjecting the agglomerated masses to an elevated temperature to sinter the powder grains together. The specific gravity of sintered bauxite is in the range of 3.50 to 3.75. Bauxite powder is sintered at pressures usually about 5000 psi, well above the criteria of 2000 psi expected for materials used in a gravel pack.

While certain preferred embodiments of the invention have been specifically disclosed, it should be understood that the invention is not limited thereto as many variations will be readily apparent to those skilled in the art and the invention is to be given its broadest possible interpretation within the terms of the following claims.

What is claimed is:

1. A method for reducing particulate material pack dissolution in a subsurface, steam injection or production wellbore comprising the steps of:

(a) providing a prepack well element comprising an inner liner, an outer liner establishing a hollow cylinder like annulus, a pack material consisting essentially of sintered bauxite solidly packed in said annulus without a binding material to establish a porous, permeable path between said inner liner and said outer liner;

(b) introducing the prepack well element into the steam injection or production wellbore; and (c) passing hot well fluids including steam through the prepack well element.

* * * * *